US005511492A

United States Patent [19]

Zaguroli, Jr.

[11] Patent Number: 5,511,492

[45] Date of Patent: Apr. 30, 1996

[54] TILT TABLE

[75] Inventor: James Zaguroli, Jr., Drayton Plains, Mich.

[73] Assignee: Knight Industries, Inc., Auburn Hills, Mich.

[21] Appl. No.: 329,205

[22] Filed: Oct. 26, 1994

[51] Int. Cl.[6] ..... A47F 5/12

[52] U.S. Cl. ..... 108/5; 108/7; 108/143; 248/393

[58] Field of Search ..... 108/1, 5, 2, 6, 108/7, 136, 143, 138, 145, 146; 248/393, 394, 395; 297/332, DIG. 10

[56] References Cited

U.S. PATENT DOCUMENTS

| | | | |
|---|---|---|---|
| 2,006,603 | 7/1935 | Nordmark et al. | 108/5 X |
| 2,051,490 | 8/1936 | Lightfoot | 108/5 X |
| 2,194,889 | 3/1940 | Lisle | 108/5 |
| 3,091,426 | 5/1963 | Bogart | 248/393 |
| 3,202,392 | 8/1965 | Wallace | 108/5 X |
| 3,848,543 | 11/1974 | Johnston | 108/5 |
| 3,977,725 | 8/1976 | Tengler et al. | 248/393 X |
| 4,385,743 | 5/1983 | Werner | 248/393 |
| 4,533,110 | 8/1985 | Hill | 248/393 X |
| 5,400,720 | 3/1995 | Stevens | 248/394 X |
| 5,431,112 | 7/1995 | Thompson | 108/7 |

FOREIGN PATENT DOCUMENTS

| | | | |
|---|---|---|---|
| 3531251 | 3/1986 | Germany | 108/6 |
| 1150379 | 4/1969 | United Kingdom | 297/DIG. 10 |
| 1233431 | 5/1971 | United Kingdom | 108/6 |

*Primary Examiner*—Peter M. Cuomo
*Assistant Examiner*—Janet M. Wilkens
*Attorney, Agent, or Firm*—John R. Benefiel

[57] ABSTRACT

A tilt table is hinged along an unload side and is spring urged to swing up towards the unload side to cause parts on the table to shift against an endwall. Pin and slot connections between fixed side plates and gussets on the table structure cause a roller supported platform to which the table is hinged to shift away from the unload side, carrying the tilt table hinged side away so that as the tilt table swings up, clearance at the unload side with the upper edge of the endwall is maintained to avoid impingement into the workspace which would otherwise occur.

5 Claims, 2 Drawing Sheets

TILT TABLE

FIELD OF THE INVENTION

This invention concerns so-called "tilt tables" which are parts storing tables disposed next to a work station to provide a worker with a quantity of parts within easy reach, the parts used in carrying out some manufacturing or assembly operation.

BACKGROUND OF THE INVENTION

The tilt table is hinged on one side and spring biased to slowly swing up by rotating about the hinge axis towards the work as the parts are removed and the weight borne by the table declines. This tilting causes the remaining parts to be moved against an upwardly extending endwall to be closer to the worker for easy removal. The conventional tilt tables have the disadvantage that as the table swings up towards the work station, the adjacent endwall upper edge sweeps towards the worker, reducing the space available to the worker in performing the assembly or other manufacturing steps.

In an effort to eliminate this problem, hydraulically positioned tables have heretofore been devised, involving complex table motions, but such equipment is costly and requires regular maintenance to keep the hydraulic components in good working order.

Accordingly, it is the object of the present invention to provide a tilt table which does not impinge into the space adjacent the unloading end as the table swings up, without the use of hydraulic equipment.

SUMMARY OF THE INVENTION

The present invention comprises a mechanical arrangement for automatically retracting a table hinge mounting as the tilt table swings up. This mechanical arrangement includes a horizontal platform mounted on rollers to be freely movable back and forth in the direction of the table swinging motion.

The table structure is hinged on one side to the side of the movable platform adjacent the unloading side of the table structure. A gusset plate affixed to each end of the unloading side of the table and wall each have a pin and slot connection with fixed sidewalls such that a camming action is produced, causing the hinge connection to be moved away from the unload side as the table structure swings up, the platform rolling away on the support rollers. This movement keeps the downwardly swinging leading edge of the endwall from moving into the workspace area as the table tilts up.

A small pusher cylinder can be included to insure that the platform rolls back and the tilt table again swings down when reloaded with parts.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
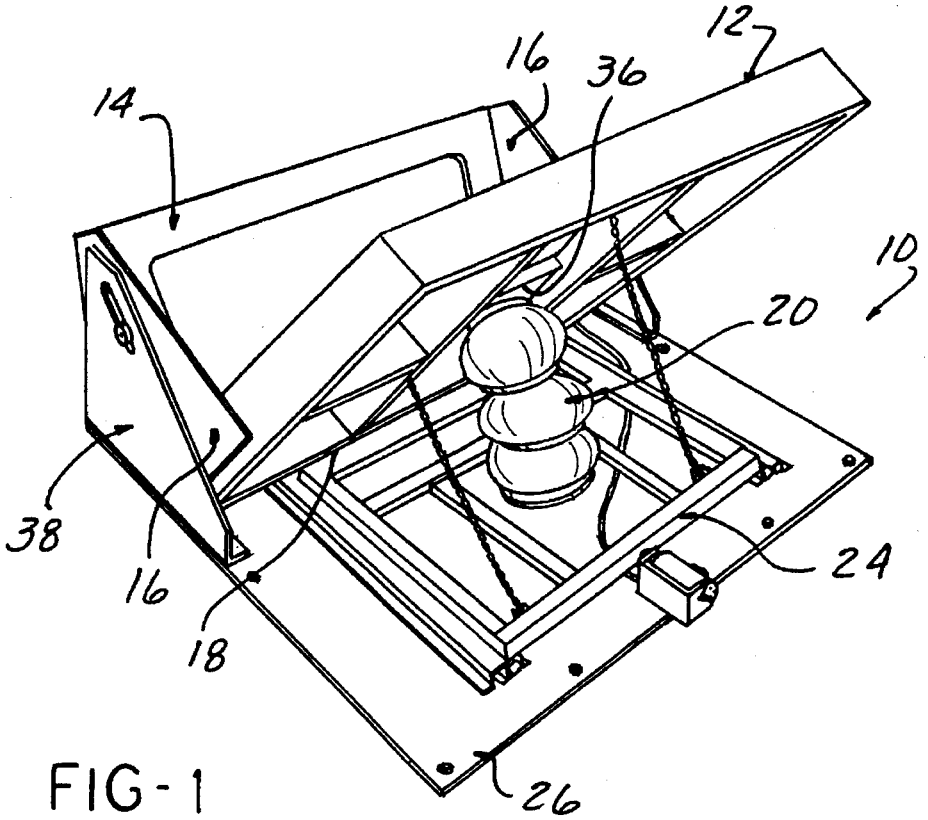
FIG. 1 is a perspective view of the tilt table according to the invention, from the end opposite the unload end of the tilt table.
Figure 2:
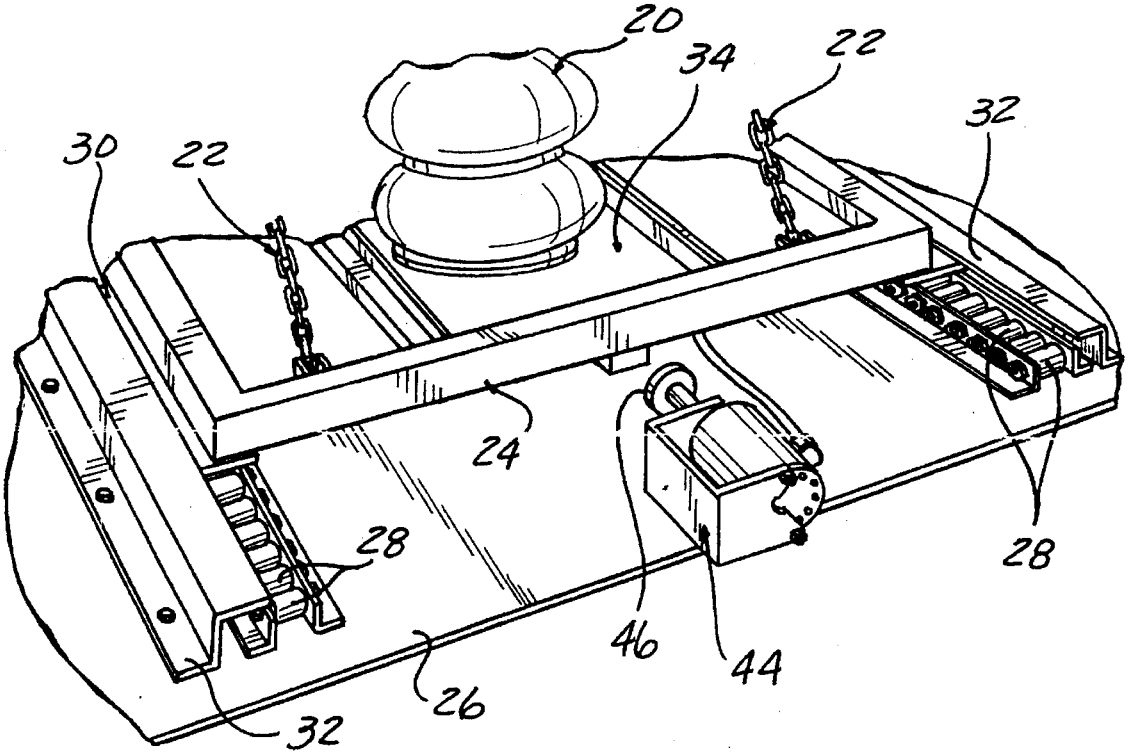
FIG. 2 is a fragmentary enlarged perspective view of the end of the tilt table shown in FIG. 1.
Figure 3:
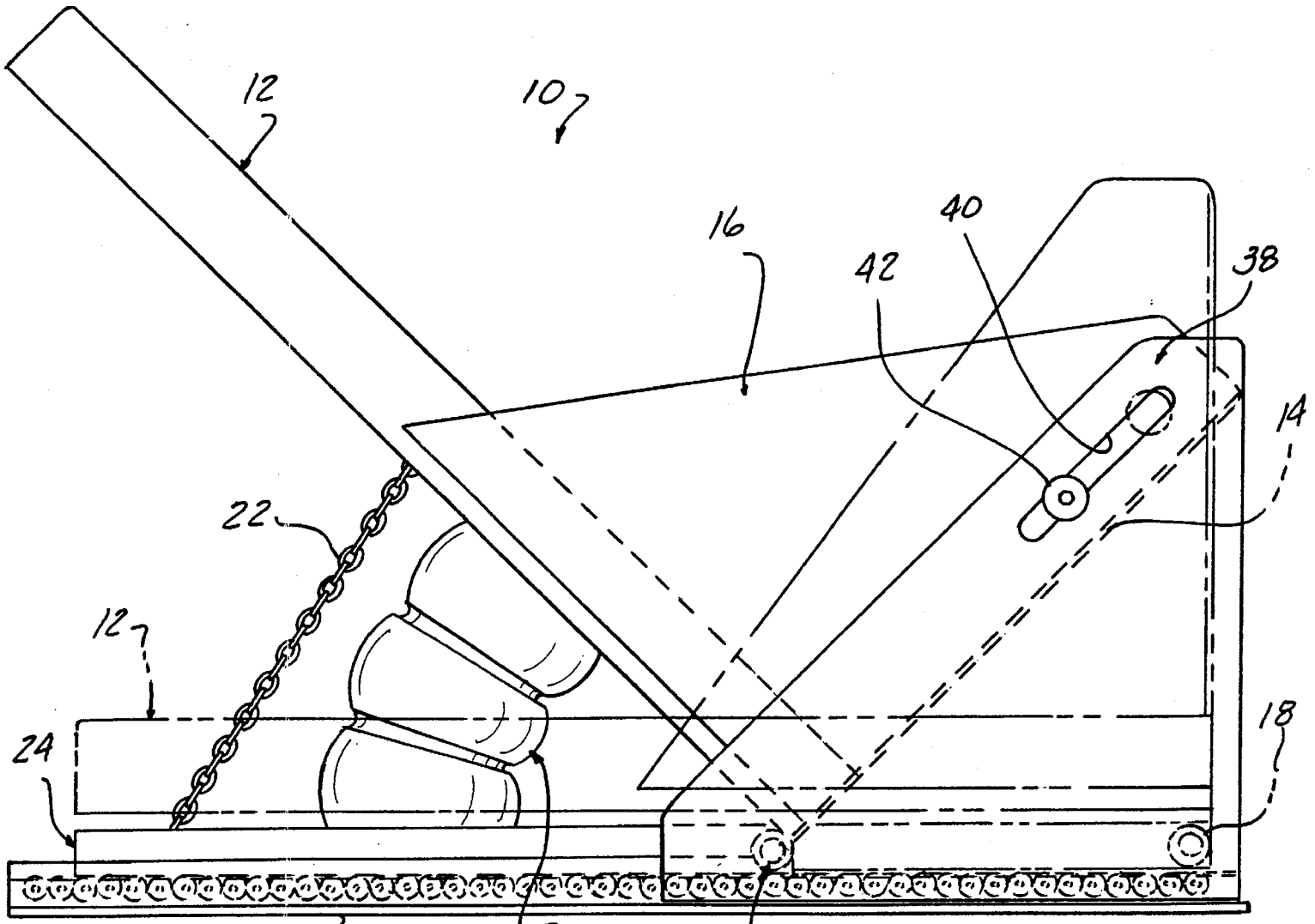
FIG. 3 is a side view of the tilt table shown in FIGS. 1 and 2, with the upward tilting motion shown in phantom.

Referring to the drawings, the tilt table 10, according to the present invention, includes a table member 12 of welded steel construction adapted to support workpieces (not shown) which are loaded onto the table member 12, with the table member 12 in its lower position shown in phantom in FIG. 3. An endwall 14 is attached to one side of the table member 12 reinforced with a gusset plate 16 on either end to form a table structure. The end wall 14 and gussets 16 form a bin-like confinement as the table member 12 swings upwardly as shown in FIGS. 1 and 3 about a hinge axis 18. Such movement has conventionally been used to cause the parts to slide down to the right hand, or unload side of the table member 12 to keep them within easy reach of the worker.

As parts are unloaded, this upward swinging movement is induced by a pneumatic spring 20, precharged with air pressure to a predetermined level such that when the table member 12 is fully loaded, the weight of the parts will compress the pneumatic spring 20 and enable the table to assume a lower, more nearly horizontal position. But, as parts are removed and the weight supported by the table member 12 is reduced, the pneumatic spring 20 will force the table member 12 to swing upwardly to a point of full extension whereat a pair of chains 22 limit further movement.

As mentioned, the purpose of this arrangement is to provide easier removal by a worker to unload the remaining parts from the table member 12 at the unload side to the right as viewed in FIG. 3 of the table member 12 by keeping the parts collected against the endwall 14.

According to the concept of the present invention, a platform 24 is provided located beneath the table member 12, platform 24 being slidable on a fixed base plate 26. This slidable support is provided by a linear array of rollers 28 on each side, mounted parallel to each other and extending in a direction towards the unload side of the table member 12. The platform 24 has a flange piece 30 on each side which is confined beneath fixed rails 32 attached to the base plate 26 to maintain the alignment of the movable platform 24.

Platform 24 also includes a support plate 34 to which the lower end of the pneumatic spring 20 is anchored, the upper end engaged with a plate 36 affixed to the underside of the table member 12 such that as the table member 12 swings downwardly towards the platform 24, compression of the pneumatic spring 20 results. The air pressure in the pneumatic spring 20 is set so that the weight of the particular part will cause the table 12 to assume a horizontal or more nearly horizontal position.

The motion limiting chains 22 are affixed at their lower ends to the rearward edge of the platform 24 and at their upper ends to the underside of the table member 12. The unload side of the table member 12 is hinged at 18 to the unload end of the platform 24.

Cam means are provided constituted by a pin and slot connection established between a pair of fixed side plates 38 attached to the base plate 26 and the gusset plates 16 of the table member 12. In this instance, a slot 40 is formed in each of the side plates and a pin 42 projects from each side plate 38 through the slot 40 of the fixed side plates 38, but this could be reversed.

The pin and slot connections cause a camming action which results in a shifting of the hinges 18 away from the unload side as the table member 12 swings upwardly, by rolling of the platform 24 away from the unload side on the roller sets 28. This in turn has the effect of maintaining the space on the unload side of the table member free from any impingement of the upper end of the end plate 14 as the table member 12 swings up towards the unload end. The operator is thus not crowded out of position nor is required to change his or her working stance as the upward swinging motion of the table takes place.

A constant force actuator 44 is also provided which may be pneumatically operated and has a plunger 46 which engages the platform 24 as the platform 24 moves fully to the left away from the unload end. The plunger 46 exerts a constant counter pushing force, such as to ensure that the table member 12 will again lower when reloaded with parts, the plunger 46 overcoming any tendency for the table structure to get hung-up in the upwardly tilted position.

Accordingly, it can be appreciated that the crowding of the operator is avoided by a relatively simple arrangement, not requiring maintenance or adjustments, etc. The tilt table having this capability can be constructed at relatively low cost.

I claim:

1. A tilt table comprising:

fixed support structure including a base plate having one side and a side opposite said one side;

a platform mounted on said base plate for linear movement towards and away from said one side of said base plate, said platform having one side adjacent to said one side of said base plate;

a table structure including a table member having one side hinged to said one side of said platform adjacent said one side of said base plate;

said table member also having an endwall affixed and extending upwardly from said one side of said table member;

spring means urging said table member to swing upwardly from said platform about said hinged one side thereof to move towards said one side of each of said platform and said base plate; and, cam means acting directly between said table structure and said fixed support structure constraining said platform and said hinged one side of said table member to be shifted away from said opposite side of said base plate as said table member swings up from said platform.

2. The tilt table according to claim 1 wherein said fixed support structure includes a pair of side plates fixed at either end of said one side of said base plate, and said table member endwall, including a pair of gusset plates adjacent a respective support structure side plate, and said cam means comprises a pin and slot connection between adjacent gusset plates and side plates constraining said platform to move away from said one side of said base plate as said table member swings upwardly on its hinge.

3. The tilt table according to claim 1 further including a pair of sets of rollers arranged in a linear array extending towards and away from said one end of said base plate, said platform resting on said pair of sets of rollers to be supported for linear movement thereon.

4. The tilt table according to claim 3 further including means engaging said platform at a side opposite said one side as said platform reaches a full travel position away from said one side of said base plate, and urging said platform to move in the opposite direction.

5. The tilt table according to claim 3 further including a pair of confinement rails, a flange on each side of said platform extending out and over a respective roller array, each confinement rail overlying a respective platform flange.

* * * * *